US007350447B1

(12) United States Patent
Smith

(10) Patent No.: US 7,350,447 B1
(45) Date of Patent: Apr. 1, 2008

(54) COUNTER-MINING USING LASER INDUCED PRESSURE WAVE

(76) Inventor: David C. Smith, 44 Candlelight Dr., Glastonbury, CT (US) 06033

( * ) Notice: Subject to any disclaimer, the term of this patent is extended or adjusted under 35 U.S.C. 154(b) by 229 days.

(21) Appl. No.: 10/995,832

(22) Filed: Nov. 23, 2004

(51) Int. Cl.
*F41H 11/16* (2006.01)

(52) U.S. Cl. ..... 89/1.13; 102/403

(58) Field of Classification Search ..... 102/402, 102/403; 89/1.13
See application file for complete search history.

(56) References Cited

U.S. PATENT DOCUMENTS

| | | | | |
|---|---|---|---|---|
| 3,090,306 | A * | 5/1963 | Reuther | 102/403 |
| 6,528,763 | B1 | 3/2003 | Lahram et al. | 219/121.85 |
| 6,799,499 | B2 * | 10/2004 | Seregelyi et al. | 89/1.13 |
| 2002/0108485 | A1 * | 8/2002 | Samland | 89/1.13 |
| 2004/0200341 | A1 * | 10/2004 | Walters et al. | 89/1.13 |

FOREIGN PATENT DOCUMENTS

| | | | |
|---|---|---|---|
| EP | 0 451 304 | A1 * | 10/1991 |
| GB | 2 184 068 | A * | 6/1987 |

OTHER PUBLICATIONS

D.C. Smith Laser Induced Gas Breakdown and Plasma Interaction, Amer: Inst. of Aeronautics and Astronautics Paper No. 2000-0716 (Jan 13, 2000) 22 pg.

V. H. Shui et al. Impulse Transfer From Pulsed $CO_2$ Laser Irradiation at Reincevambient Pressures, AIAA Journal V16, No. 7 (Jul. 1978) 2 pg.

"Land Mine Detection," US General Accounting Office (Apr. 2001) pp. 1; 11-18.

M.L. Kavaya, "Cidar Tutorial" NASA Website (Aug. 2, 1999) 2 pages.

N. Ferriser et al. "Analysis of Efficient Impulse Delivery and Plate Rupture by Laser-Supported Detonation Waves" Lawrence Livermore Lab (Jun. 2, 1975) pp. 1-28.

* cited by examiner

*Primary Examiner*—Stephen M Johnson
(74) *Attorney, Agent, or Firm*—C. Nessler

(57) ABSTRACT

Buried land mines, which are triggered by pressure, particularly anti-personnel mines which are triggered by the pressure of a person's foot, are destroyed by impinging laser beam pulses on the surface of the soil. With appropriately chosen beam parameters, a laser supported detonation is created in the atmosphere above the soil by each beam pulse impingement. That results in a blast wave within the soil, the pressure of which causes a mine trigger to explode the mine. A multiplicity of beam pulses are impinged on the soil surface in location- and time-coordination, to create a multiplicity of blast waves which provide pressure-time profiles within the shallow depth of the soil, sufficient to trigger mine types that are configured to resist triggering from a single detonation, whether induced by laser or chemical means.

17 Claims, 4 Drawing Sheets

COUNTER-MINING USING LASER INDUCED PRESSURE WAVE

TECHNICAL FIELD

The present invention relates to creation of pressure waves beneath the surface of the earth by means of a laser, in particular for destroying or disabling buried explosives.

BACKGROUND

Military land mines, namely, explosive devices which are dispersed upon the earth surface or at shallow depths, are intended to explode and injure or destroy an enemy person or vehicle traversing the surface, when the presence of such is sensed. A common means for sensing such presence comprises a fuse mechanism, or trigger, which responds to the downward force, or pressure, of a person or vehicle traversing the surface of the field, to then detonate the main explosive. Typically, the threshold of fuse action is set sufficiently high, so that a mine is not detonated without achieving its intended purpose. Thus, the threshold force may be set higher than that applied by small animals and other wayward objects, or in the case of anti-tank mines, by human beings.

Of course, military forces desire to remove mines placed by the enemy, in order to breach, or to clear a regular route, over a certain piece of terrain. There is, of course, a need to do the job quickly, often under adverse conditions. After hostilities cease, the military and society as a whole have an interest in mine neutralization, so their pernicious effects are not suffered by civilians seeking to peaceably regain use of the terrain for a useful purpose such as agriculture.

Thus, various means have been developed to neutralize land mines, in particular the pressure sensitive type mines with which the present invention is primarily concerned. In an old way, some expendable or specially reinforced object can be run across the mine field, to apply pressure to the surface sufficient to detonate the mines without consequential adverse effect. However, often times the terrain may not permit such, as the efficacy and cost of the means may not be acceptable. In another approach, chemical explosive charges can be detonated upon or along the surface of the earth. But other than to create a narrow breach through the field, such means is not effective unless the applied explosive is selectively placed in close proximity to the mine, which means the mine must be detected in the first instance. In another common approach, the mine is detected and then individually removed and carried away for disabling or destruction elsewhere. Again a mine has to be first found, both to remove and to avoid injury to personnel and equipment being used to remove other nearby mines. That means the detection means has to be good. For example, detectors capable of sensing changes in magnetic field strength have been long used to find ferromagnetic metal mines. But despite continual exploration of new technologies, it is a continuing problem to find mines, and to improve upon the often slow, tedious and risky work of removing them.

Furthermore, mine designers have resourcefully designed mines to defeat the detection means and to otherwise make them more of a threat. For example, mines may be made of non-metal materials, and the fuses may be configured to only detonate after n excursions of pressure beyond the threshold setting, not to respond to the characteristic pressure wave of a chemical explosive, or only to respond to a certain pressure versus time profile. In particular and with relevance to the present invention, mines may have elastically biased triggers in combination with dampeners, for instance of the kind known in fluidics. They can have the effect of requiring that a pressure to be sustained for at least tens of milliseconds. Thus, the triggers of such mines will resist being detonated by a single surface detonation, which lasts only tens of micro-seconds.

Thus, there is a continuing need for an improved means of countering mines and for making mine fields safe to traverse in an efficient and cost effect manner.

SUMMARY

An object of the invention is generate a pressure or blast wave within the shallow depths of the soil of the earth or another like medium, generally referred to here as soil, to significantly affect subsurface objects which are within the medium, e.g., to destroy mines. A further object is to create a pressure within soil which is sufficient to explode a buried weapon, in particular a pressure sensitive land mine. A still further object is to produce, within soil that contains a land mine or other buried weapon, a pressure-time profile which extends over an appreciable period of time, compared to the time of a chemical explosion.

In accord with the invention a method and apparatus for counter-mining comprise impinging one or more pulses of laser beam radiation on the surface of soil which contains mines, where the intensity of the pulse creates a laser supported detonation (LSD) at the soil surface, and an associated blast wave within the soil, wherein the pressure of the blast wave is sufficient to cause the trigger of a mine to explode the mine. Preferably, the intensity of the beam pulse is also sufficient to physically destroy a mine by penetrating it or exploding it, when a mine is exposed at the surface. In one apparatus embodiment, a laser mounted on a vehicle is sent skyward and bounced down on to the soil surface by a mirror or substitutional means. Beam pulses are repetitively sent as the mirror is adjusted to change the location of the impingement spot, so the whole of a selected soil surface is treated.

Preferably, the laser beam intensity is greater than $10^7$ W/cm$^2$ and less than about $5\times10^8$ W/cm$^2$, more preferably about $3\times10^8$ W/cm$^2$, the laser beam radiation has a wavelength of about 1.06 micron; the pulse time is greater than $10^{-7}$ sec, preferably about 100 nanoseconds; and the beam energy is about 50 joules per square centimeter.

In further accord with the invention, a particular location in the soil is subjected to the cumulative effect of several blast waves from several beam pulses. In one mode, the pulses are successive. In another mode a first impingement spot may be at the presumed mine location and a second impingement spot will be spaced apart therefrom, simultaneously, or spaced apart in time. Thus, as the pressure from the first blast wave decays, the blast wave resultant from the second pulse beam arrives, to create a desirable pressure-time profile, namely a pressure which extends over time. The laser impingement spots are moved is systematic fashion across the soil surface so that the desired pressure-time profile is achieved in the desired soil volume, so that mines are detonated. This method is useful with mines, such as those configured to respond to the pressure-time profile of a human foot, and to ignore a single blast wave—whether resulting from a LSD or a chemical explosion or other means, because the short direction of the force applied to the soil. More than two beam pulses may be used to create the desired pressure-time profile. The radiation beam pulse from a laser may be split to impinge in two different spots.

The foregoing and other objects, features and advantages of the present invention will become more apparent from the following description of preferred embodiments and accompanying drawings.

DESCRIPTION

In the present invention laster irradiation on the surface of soil in vicinity of a land mine creates a laser detonation wave which causes a pressure wave in the soil, sufficient to cause a pressure sensitive mine to detonate. The invention is described primarily in terms of detonating anti-personnel land mines, the detonators of which are triggered by a device which senses the pressure of a person's foot on the earth surface. Typically, such devices are overlaid by 15 to 30 cm of soil. It will be evident that the invention may be used with other types of mines and to affect other devices which respond to pressure waves in the soil, and the use of the term mine(s) in the claims will apply to any explosive device which is contained in soil and responsive to pressure of some sort. As is well known, soil can have different characteristics. Generally, soil is comprised variously of stone pieces, sand, clay, volcanic matter, organic matter, and mixtures thereof; and thus, it may be generally considered as a largely granular medium. In distinction to the air atmosphere, soil is treated as a solid.

Figure 1A:
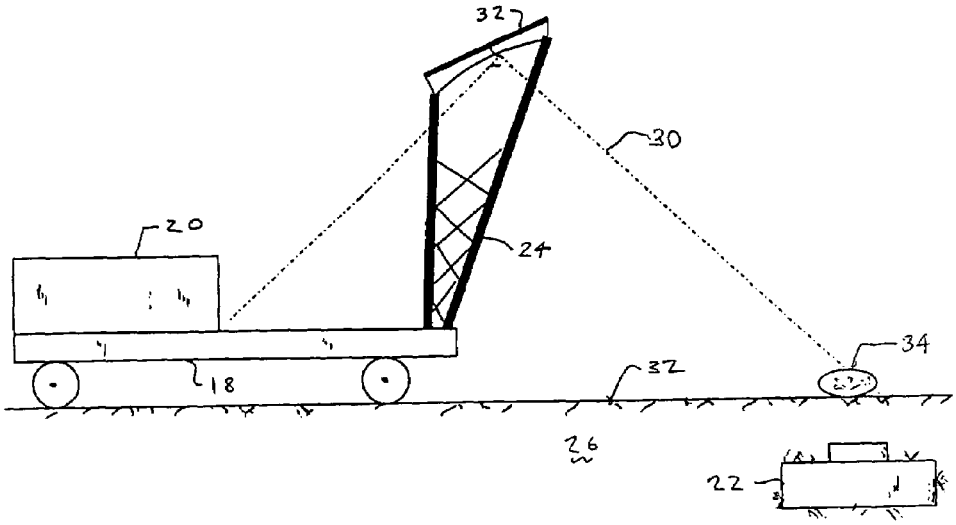
FIG. 1A is a schematic elevation drawing of counter-mining apparatus including a laser and mirror, in combination with a mine field shown in cross section.
Figure 1B:
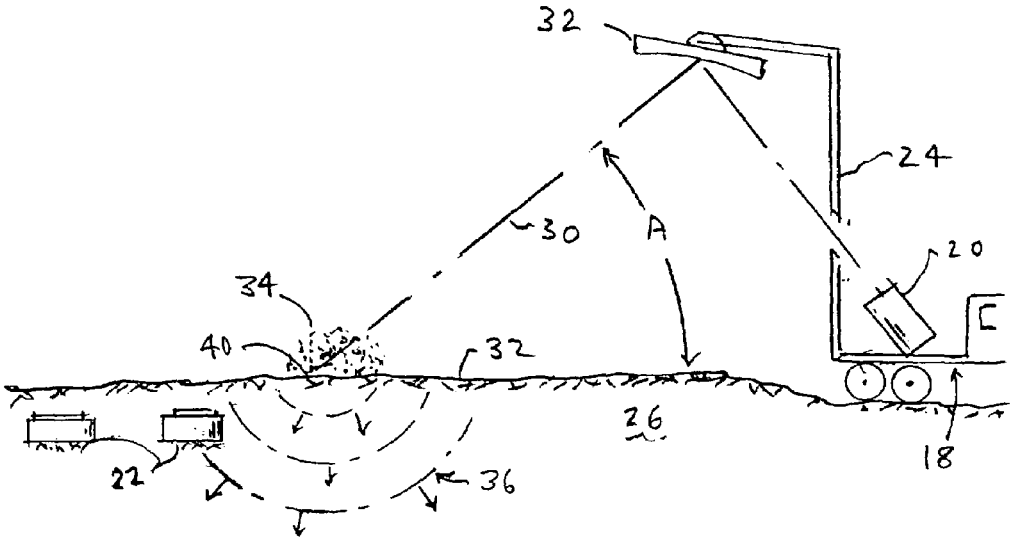
FIG. 1B is a more detailed schematic drawing, like FIG. 1A.

FIG. 1 shows schematically an embodiment of apparatus of the invention. Laser 20 is mounted on a transport vehicle 18, positioned with a safe stand off distance from the mines 22 of a minefield in soil 26. A pulsed beam 30 from the laser is directed upwardly to a mirror 32, which is mounted on the combination derrick and shield 24 of the vehicle. The reflected beam 30 runs downwardly to an impingement spot 40 on the surface 32 of the soil. The impingement angle A is preferably high, in that it is desirable to avoid spreading the beam over too large an area, and to avoid masking of the beam impingement by soil surface projections. On the other hand, the mirror is desirably kept remote from the expected explosion of the mine and that would lead to low angle A. Obviously, the laser might be mounted on the derrick and the mirror omitted, in another embodiment. In other embodiments, different means can be used to either hold the laser or a mirror high above the surface, including aircraft and the like. Other means than a mirror, for instance a prism or a corner cube, can be used for deflecting the beam. By controllably changing the angle of the deflecting means to the incoming beam, the location of impingement spot on the soil surface can be varied.

When laser beam 30 first impinges on the surface of the soil at spot 40, there is a Laser Supported Detonation (LSD) at the soil surface. This phenomenon is described further below. The LSD shock wave propagates into the soil. When the pressure pulse from the LSD enters the soil and travels through it, it is referred to here as the blast wave. The blast wave 36 is illustrated in FIG. 1 by radiating rings 36 within the soil cross section. The intensity of the blast wave will decrease sharply with distance from spot 40 but, nonetheless, within some proximity to spot 40, as blast wave 36 travels through the soil, it either physically destroys nearby mines 22, or triggers the pressure sensitive fuses of the nearby mines 22. The sufficient mine-destroying effect can be achieved even when a mine is some distance from the impingement point 40. The distance from spot 40 at which the blast wave will be effective depends on the strength of the LSD, the attenuation of the wave as it propagates within the soil, the strength of a mine body and the sensitivity of the mine trigger. If the mine is exposed on the surface, it may be destroyed by direct action of the beam, or by the pressure effects of the LSD.

The following description uses as an illustration the case where the mine pressure sensitive fuse is triggered. However, it will be understood that the description will apply analogously to a situation where the goal is to physically destroy the mine.

In use for counter-mining a minefield, which comprises a multiplicity of mines upon or just below the surface of the soil, the laser impingement action is repeated, as mirror 32 is moved to change the location of the impingement spot on the soil surface. Thus, in one mode of operation, in quick sequence LSDs are created at spaced apart impingement spots 40 on the soil surface in a methodical way, to clear whatever portion of soil surface is desired—for instance to make a path or to seek to remove all mines. And, the spots are sufficiently close so that for many, if not every point, within the soil which lies beneath the surface of the portion selected for de-mining, up to a certain shallow depth (typically up to about 30 cm depth), experiences at least a sufficient pressure wave to trigger the mine. Thus, in its optimum performance, the invention will cause all mines in the field to be destroyed or detonated, even though their locations are not precisely known. Calculation and empirical data may be used to determine what is a satisfactory spacing of the impingement points. The invention may be used in combination with other means of counter-mining and thus in practical application, a substantial volume of the shallow soil beneath the selected surface portion, rather than every point in the volume, will be subjected to the pressure, or pressure-time profile, sufficient to detonate mines.

Figure 6:
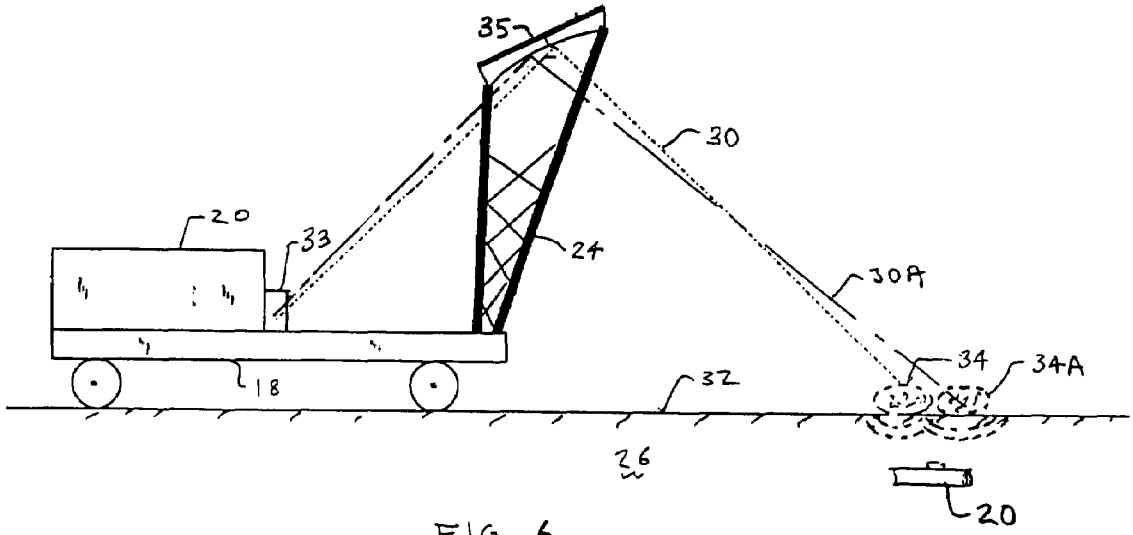
FIG. 6 is like FIG. 1A, showing a laser which has a beam splitter and two beams.

In a simple mode of counter-mining, each spaced apart spot on the soil surface is sequentially hit with one pulse. Other more sophisticated beam impinging variations may be used to create more complex blast wave profiles, which are aimed at triggering mines which have more sophisticated fuses, as described in the Background. For example: (a) any given spot may be subjected to one or more pulses and resultant LSDs, before the next spot is hit; (b) the duration of the beam pulse at a spot may be altered; (c) two or more lasers may impinge on the same spot, or on nearby spots, simultaneously, or at slightly different times; and, (d) a single beam may be split by conventional means, so that the two parts of the beam arrive, at slightly different times, at closely adjacent spots. FIG. 6, a modification of FIG. 1A, illustrates a conventional beam splitter 33 positioned at the outlet of the laser 20, to generate two beam pulses 30, 30A, which hit nearby spots 34, 34A.

In alternatives (c) and (d), the resultant combined blast wave may be designed to have an intensity and duration (or pressure-time profile) which defeats the design or programming of a mine trigger to ignore a single blast wave. For a first example, suppose a single blast wave would not be simulative of the profile of a slowly walking person, and the mine trigger is configured to respond only to a pressure-time profile of a slow walker. Thus, the mine trigger is in effect configured to ignore the pressure pulse of a single blast wave, because it is too short in time. But, with the two sources and two beams impinging on essentially same spot sequentially the combining of the resultant two blast waves creates in the soil creates a pressure profile which is sufficiently simulative of the pressure profile of a walker, so the trigger responds and does detonate the mine. For a second example, suppose a mine is hypothetically located at point X, and likewise requires a certain pressure-time profile. A first beam pulse is impinged at or near X. A second beam pulse is simultaneously impinged at point Y which substantially displaced from X with respect to the time of travel of a blast wave through soil—nominally the speed of sound, and the rate of decay of pressure from the blast wave at a point in the soil. Thus, the second blast wave will arrive at X later in time than the first wave, and by selection of Y, before the pressure of the first wave decays to zero. A pressure wave sufficient to detonate mines will be effected within a certain radius of point X.

Repetition, while moving the location of X and Y on the soil surface, will subject substantially the volume of shallow soil underlying the selected surface portion of the minefield to mine-destruction pressure waves. Conventional beam splitters can be used to make one beam do the work of two or more sources and beams. In either of the foregoing examples, additional lasers and or beam impingements may be simultaneously applied; and, the approaches of the two examples can be combined in one counter-mining process.

Commercially available laser systems may be used in practice of the invention. Conventional electronic control systems may be used to control the output and timing of the laser actions. The angling of the mirror or other deflecting means may be likewise controlled, with use of electromechanical devices.

The following explains in more detail the physics and operational parameters of the invention. Laser radiation tends to interact with any medium through which it passes, with the degree depending on frequency of the radiation and the character of the medium. The understanding here is based on analysis from effects of lasers on metal plates and other objects.

In an example of the invention using a single LSD, a pulsed laser beam from a $CO_2$ laser, having a pulse time greater than $10^{-7}$ sec, is directed onto the surface of the soil. Some of the soil vaporizes in response to the initial part of the beam. That creates, within the local air, a gas having free electrons. The rest of the beam is then absorbed by the vaporized material, to create plasma. Very high pressures are generated within the plasma, and a pressure pulse or shock wave moves outwardly from the surface at hypersonic speed. This familiar laser phenomenon is called laser supported detonation, or LSD. The resultant pressure pulse or wave is referred to as a LSD wave. See Y. P. Razier, "Laser Induced Discharge Phenomina" Studies in Soviet Science, Physical Sciences, Consultants Bureau, New York 1977; and, D. Smith, "Laser Induced Gas Breakdown and Plasma Interaction", Amer. Inst. of Aeronautics and Astronautics, Paper No. 2000-0716, 38$^{th}$ Aerospaces Sciences Meeting, January 2000, the disclosures of which are hereby incorporated by reference.

When pulse time of greater than $10^{-7}$ sec, the calculated threshold for intensity I of the beam, in W/cm$^2$, which when applied at the soil surface is sufficient to cause breakdown, is $1.6\times10^8/\lambda$, where $\lambda$ is the wavelength in microns. For a $CO_2$ laser, where $\lambda$ is 10.6 micron, the threshold I will be about $1.5\times10^7$ W/cm$^2$. For a more preferred neodymium or YAG laser or an analogous output device, where $\lambda$ is 1.06 micron, threshold I, or $I_{BD}$, will be about $1.5\times10^8$ W/cm$^2$.

Figure 2:
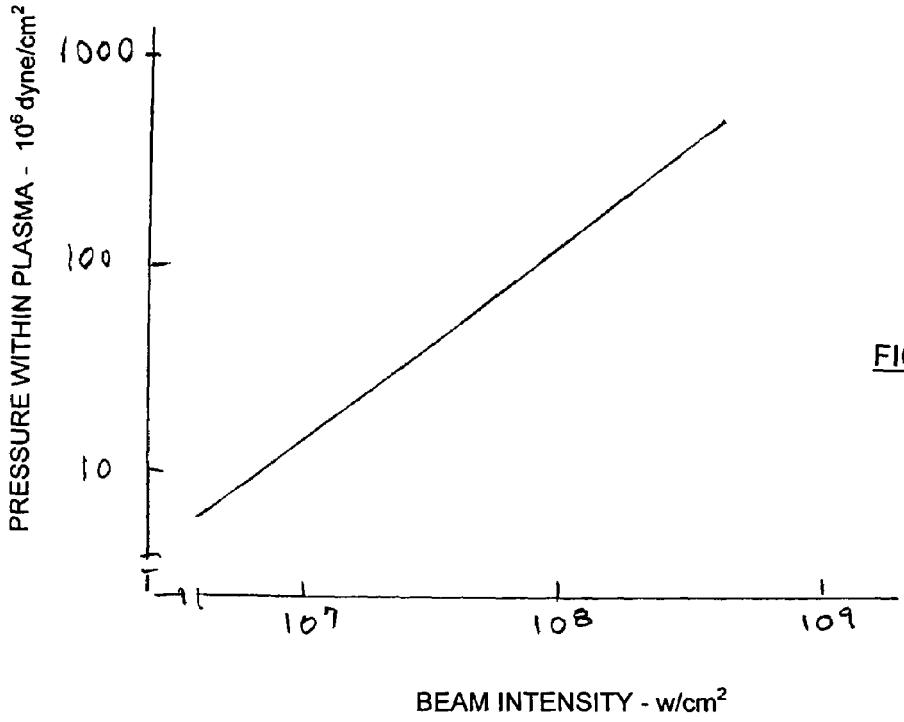
FIG. 2 graphically shows the relationship between pressure within a plasma and beam intensity in a laser supported detonation.

FIG. 2 graphically shows how calculated pressure within the plasma increases with beam intensity. It might appear from the Figure that raising beam intensity would be desirable. But as indicated below, that is not the case.

The LSD pressure wave impinges on the soil surface and creates a shock wave, as it would on any other solid object. See J. E. Lowder et al., "High Energy Pulsed CO2 Laser-Target Interactions in Air", Journal of Applied Physics, Vol. 44, pp. 2759-2762, June 1973. A pressure wave called a blast wave is thus induced within the soil.

Figure 3:
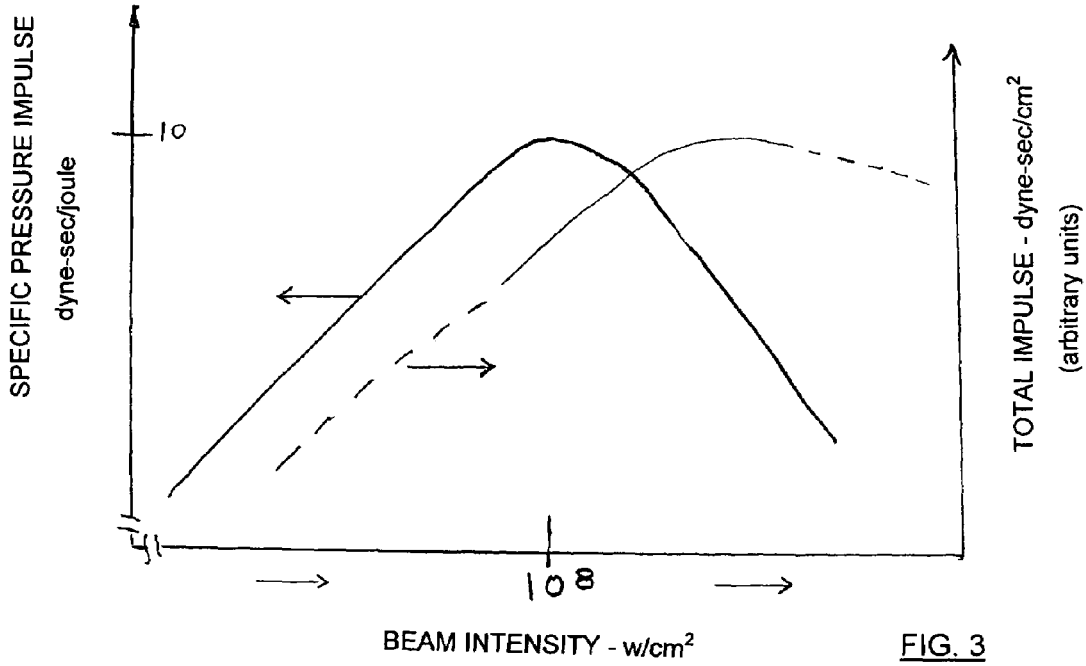
FIG. 3 graphically shows the relationship between beam intensity and both specific pressure impulse and total pressure impulse, which is applied to soil surface by a laser supported detonation.

Impulse I is the integral of pressure over time. Specific impulse $I_{sp}$ is the impulse which is transferred to the soil by the LSD, divided by beam pulse energy. FIG. 3 shows how specific impulse $I_{sp}$ first increases with beam intensity, but then decreases when the intensity substantially exceeds an about $10^8$ W/cm$^2$ level, contrary to what might be expected. This can be attributed to beam-gas interaction phenomena, including excess generation of plasma along the beam path, which prevents the beam from impinging in close vicinity of the soil surface, the initial impingement spot.

FIG. 3 also shows conceptually how the total impulse I, and thus the energy within the blast wave, has a different peaking-curve relationship with respect to intensity. Total impulse peaks at a point beyond the about $10^8$ W/cm$^2$ level, at which specific impulse $I_{sp}$ peaks. Thus, given the approximations involved relative to the precision of the $10^8$ W/cm$^2$ level, and applying judgment, the beam output will be adjusted in carrying out the invention, so that the intensity at the surface impingement point will be about $3\times10^8$ W/cm$^2$.

Thus, in the practice of the invention, to achieve effective coupling and good blast waves, the specific beam intensity should be greater than $10^7$ W/cm$^2$ and less than about $5\times10^8$ W/cm$^2$, preferably in then range $1\times10^8$ W/cm$^2$ to $3\times10^8$ W/cm$^2$. If too low an intensity is used, mines will mostly not be affected. If too high intensity is used, then the plasma and LSD zone will be at a point moved away from the soil surface. The coupling and resultant blast wave pressure will be decreased, and the counter-mining will not be sufficiently effective.

For the about $3\times10^8$ W/cm$^2$ intensity indicated above, when using a 1.06 micron pulsed laser with an beam energy of about 50 j/sq cm per pulse and a pulse duration of about 100 nanoseconds, with a beam spot size of about 3 cm. Preferably, for rapid counter-mining of a large field, the laser will operate at about 40 pulse/sec and have a total power of about 20,000 watts. From FIG. 2, with an applied beam intensity of about $3\times10^8$ W/cm$^2$, the pressure in the LSD is about $500\times10^5$ dynes cm$^{-2}$. A one-dimensional analysis in accord with Razier, indicates that pressure within the LSD will be: $P=6.9\times10^{-4}I^{2/3}$ bars (standard atmospheres).

To simulate the pressure of the foot of a typical man necessitates a pressure of about $3.5\times10^5$ dynes cm$^{-2}$ in vicinity of the mine. The pressure of the LSD wave at the soil surface, for a specific beam intensity of about $10^8$ W/cm$^2$, is about 100 bars, or $10^8$ dynes/square cm. Making assumptions about attenuation in the soil, that should provide pressure equivalent to the foot of a man within a radius of about 70 cm of the center of the impingement spot. Thus, about 2200 pulses will be sufficient to clear about 2740 square meters (about an acre). If the laser has a pulse rate of about 20/sec, the land can be counter-mined in about two minutes.

Figure 4:
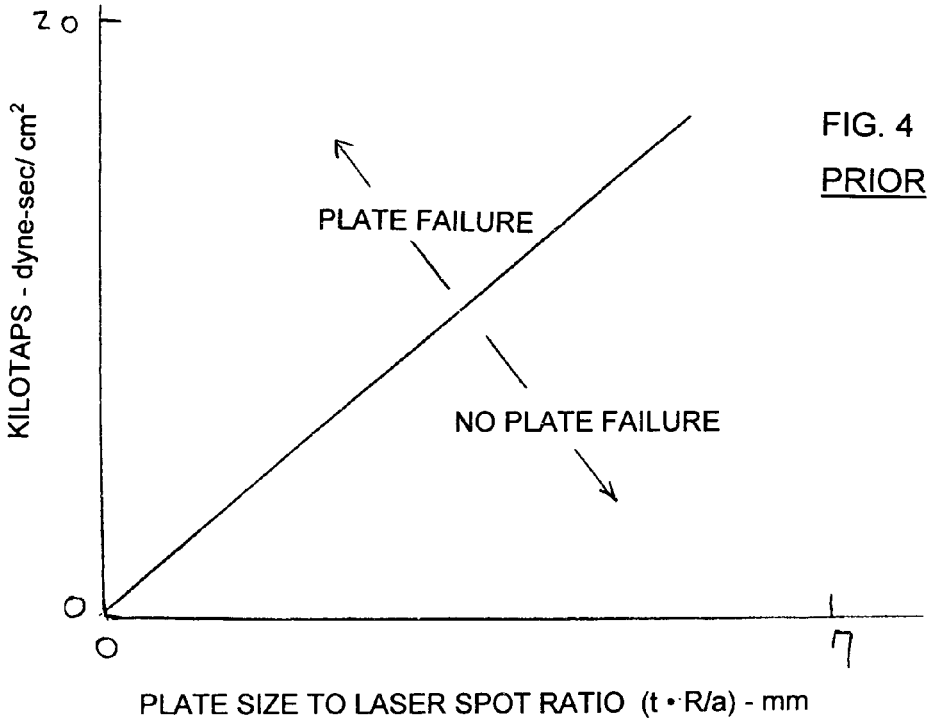
FIG. 4 PRIOR ART
FIG. 4 graphically shows the prior art relationship between impulse per unit area (kilotaps) and a ratio of plate size to laser spot size.

The prior art data of FIG. 4 shows how LSD impulse per unit area of beam spot (Kilotaps), necessary to penetrate an aluminum plate, is related to the parameter t.•R/a, where t is plate thickness, R is the radius of the plate specimen, and "a" is the radius of the laser beam spot. See N. Ferritech, "Analysis of efficient impulse delivery and plate rupture by laser supported detonation wave," Lawrence Livermore Lab UCRL Report 51836, Jun. 2, 1975. As expectable, as thickness increases, the required impulse increases. In use of the invention, it is contemplated that most mines would be contained in the soil so they are buried and thus not visible. Sometimes, some or all of the mines may be exposed partially or fully at the surface of the soil. Thus, in an embodiment of the invention suitable for such situation, the laser beam impulse is of sufficient intensity to penetrate the surface of the mine and thus either explode or otherwise disable it. That mode of the invention is referred to as physically destroying the mine, herein. The related plate penetration data of FIG. 4 indicate how such mines may be physically destroyed.

Figure 5:
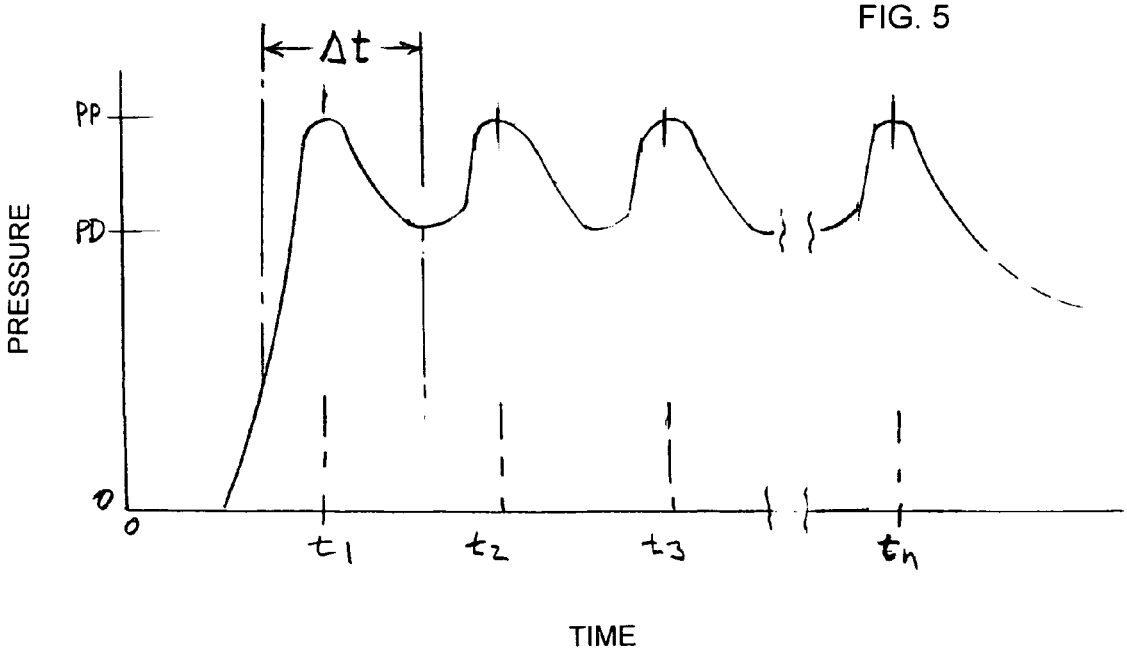
FIG. 5 graphically shows the pressure-time profile, namely the cumulative-effect pressure wave produced by a multiplicity of beam impingements which are spaced out in time.

As mentioned in the Background, it may be desirable to achieve within the soil a pressure versus time profile which extends over an appreciable period of time, i.e., for milliseconds, which time period is substantially greater than the blast wave or pressure time of either a chemical explosion or a single LSD. To do this, the laser beam is repetitively pulsed to produce a sequence of LSD, either at the same spot, or at one or more spots in close proximity to a first LSD spot. FIG. 5 schematically illustrates the effect of such repetitive LSDs at nominal times $t_1$, $t_2$ . . . $t_n$. The nominal duration of the blast wave is $\Delta t$, being the timer interval over which the blast wave pressure P in the earth rises to a peak pressure PP and then decays. In the invention, the time between one LSD and the next LSD is sufficiently close, in relation to $\Delta t$, as to sustain pressure within the soil to nominal level PD, shown on FIG. 5. Thus, the mine trigger "sees" a continuing pressure at a certain average level, and thus the trigger cannot relax and reset, as it could if the LSDs were more widely spaced part in time. For example, if the nominal duration $\Delta t$ of a LSD induced blast/pressure wave is about ten microsecond, then 100 closely spaced in time laser beam pulses can make the mine "see" a pressure wave which extends over about a millisecond. As mentioned above, the travel time of a blast wave within soil can be utilized, so that two simultaneous beam impingements at different distances from the presumed mine location will result in the same kind of result, namely, blast waves arriving at the location at different times, so there is a cumulative effect of the waves, as just described, wherein pressure in the soil at said presumed location is extended over time.

Although this invention has been shown and described with respect to a preferred embodiment, it will be understood by those skilled in this art that various changes in form and detail thereof may be made without departing from the spirit and scope of the claimed invention.

I claim:

1. A method for counter-mining of a land mine contained within soil, wherein the mine has a trigger which responds to pressure, which method comprises:

generating a pulse of radiation from a laser and transmitting the radiation as a beam pulse;

impinging the beam pulse on a first impingement spot at the surface of the soil, without impinging the beam pulse on said mine;

wherein the beam pulse has an intensity sufficient to create a laser supported detonation (LSD) at said soil surface, to thereby create an associated blast wave within the soil in vicinity of the first impingement spot; and, wherein the pressure of the blast wave is sufficient to cause the trigger to explode said mine.

2. The method of claim 1 wherein a multiplicity of mines are contained within the soil, and at least one mine is exposed on at the surface, wherein the intensity of the beam is sufficient to destroy said at least one exposed mine.

3. The method of claim 1 wherein the laser beam radiation has a wavelength of about 1.06 micron, wherein the pulse time is greater than $10^{-7}$ sec, and wherein the beam intensity is at least $10^8$ W/cm$^2$.

4. The method of claim 1 wherein the beam energy is about 50 joules per square centimeter and the pulse time is about 100 nanoseconds.

5. The method of claim 1, wherein further comprises: generating and impinging repetitive pulses of said laser beam radiation onto the surface of soil, to thereby create a multiplicity of blast waves spaced over time within the soil, so that the pressure in the soil is elevated for a substantial period of time, compared to the time of pressure elevation which results from a single LSD.

6. The method of claim 5 wherein a multiplicity of mines are contained within said soil; and wherein at least one of said mines has a trigger which does not respond to the blast wave which results from impingement of only a single one of said multiplicity of beams.

7. A method for counter-mining of a land mine contained within soil, wherein the mine has a trigger which responds to pressure, which method comprises:

generating a pulse of radiation from a laser and transmitting the radiation as a beam pulse;

impinging the beam pulse on a first impingement spot at the surface of said soil;

wherein the beam pulse has an intensity sufficient to create a laser supported detonation (LSD) at said soil surface, to thereby create an associated blast wave within the soil in vicinity of the first impingement spot;

wherein the intensity of the laser beam pulse if greater than $10^7$ W/cm$^2$ and less than about $5\times10^8$ W/cm$^2$; and, wherein the pressure of said associated blast wave is sufficient to cause the trigger to explode the mine.

8. A method for counter-mining of a land mine contained within soil, wherein the mine has a trigger which responds to pressure, which method comprises:

generating a pulse of radiation from a laser and transmitting the radiation as a beam pulse;

impinging the beam pulse on a first impingement spot at the surface of said soil;

wherein the beam pulse has an intensity sufficient to create a laser supported detonation (LSD) at said soil surface, to thereby create an associated blast wave within the soil in vicinity of the first impingement spot; and, repetitively generating and impinging a similar laser beam pulse on a multiplicity of other impingement spots on a selected portion of the surface of the soil, which spots are spaced apart from said first impingement spot, to thereby create a multiplicity of LSD and associated blast waves which are sufficiently close in time to provide pressure within the soil which extends over a time which is substantially greater than the duration of pressure from a single LSD and blast wave, wherein said extended-time pressure is sufficient to cause the trigger to explode the said mine.

9. A method for detonating land mines contained upon or within soil using a laser, wherein the mines explode when triggers respond to predetermined pressure-time profile which extends over a greater time than the duration of a blast wave resulting from a laser supported detonation created by impingement of a single laser beam pulse on the surface of the soil, which comprises:

generating a multiplicity of pulses of radiation from one or more lasers and impinging the radiation as a multiplicity of beam pulses on one or more impingement spots on the surface of soil;

wherein each beam pulse has an intensity sufficient to create a laser supported detonation (LSD) at said soil surface and an associated blast wave within the soil in vicinity of the beam pulse impingement spot; and, wherein the multiplicity of said associated blast waves is sufficient closely spaced in time to create a pressure-time profile at a point within the soil which causes one of said mine triggers to explode an associated mine.

10. The method of claim 9 wherein at least some of said multiplicity of beam pulses are from the beam of a laser which is split into a first split beam and a second split beam prior to reaching the impingement spot.

11. The method of claim 10 wherein at least two beam pulses are impinged on the soil surface, each at a different time.

12. The method of claim 11 wherein the impingement spots of the two beam pulses are the same.

13. The method of claim 9 wherein at least two beam pulses are impinged on the soil surface at impingement points which are spaced apart.

14. The method of claim 13 wherein said at least two beam pulses are impinged on the soil surface simultaneously.

15. The method of claim 9 wherein at least two lasers are used; wherein at least one beam pulse from a first laser is first sent upwardly to a means for deflecting the beam; and, wherein said at least one beam pulse is then deflected downwardly onto the soil surface at a desired and variable location.

16. The method of claim 9 wherein the trigger of a mine buried in said soil is responsive to the foot pressure of a human being traveling across the soil surface and unresponsive to the pressure of a blast wave created by impingement on the soil surface of only a single one of said multiplicity of beam pulses.

17. The method of claim 9 wherein the trigger of a mine buried in said soil is responsive to the amount and duration of pressure resulting from the single foot fall of a human being and not responsive to pressures which are substantially higher and shorter in duration.

* * * * *